United States Patent [19]

Peters

[11] Patent Number: 4,683,712

[45] Date of Patent: Aug. 4, 1987

[54] SPINNING MACHINE

[75] Inventor: Erwin Peters, Niederzier, Fed. Rep. of Germany

[73] Assignee: W. Schlafhorst & Co., Monchen-Gladbach, Fed. Rep. of Germany

[21] Appl. No.: 888,826

[22] Filed: Jul. 22, 1986

[30] Foreign Application Priority Data

Jul. 23, 1985 [DE] Fed. Rep. of Germany ..... 3526309

[51] Int. Cl.[4] ..... D01H 13/16

[52] U.S. Cl. ..... 57/81; 57/83; 57/87

[58] Field of Search ..... 57/78, 80, 81, 83, 86, 57/264, 265; 19/0.25, 236, 239

[56] References Cited

U.S. PATENT DOCUMENTS

| | | | |
|---|---|---|---|
| 3,695,022 | 10/1972 | Landwehrkamp | 57/81 X |
| 4,432,195 | 2/1984 | Stahlecker | 57/81 X |
| 4,450,677 | 5/1984 | Horvath et al. | 57/81 |
| 4,510,645 | 4/1985 | Glock | 57/81 X |

*Primary Examiner*—Donald Watkins

*Attorney, Agent, or Firm*—Herbert L. Lerner; Laurence A. Greenberg

[57] ABSTRACT

A spinning machine for producing a thread includes a multiplicity of spinning stations at which sliver is spun into thread, each of the spinning stations including a thread-break sensor and a slubbing-stopping device connected to the sensor and released by an electrical current from the sensor for arresting the sliver after each thread break sensed by the sensor, each slubbing-stopping device including an electrical energy storage device, a charging circuit for the storage device, and a device for discharging the storage device for operating the slubbing-stopping device.

2 Claims, 3 Drawing Figures

SPINNING MACHINE

Figure 1:
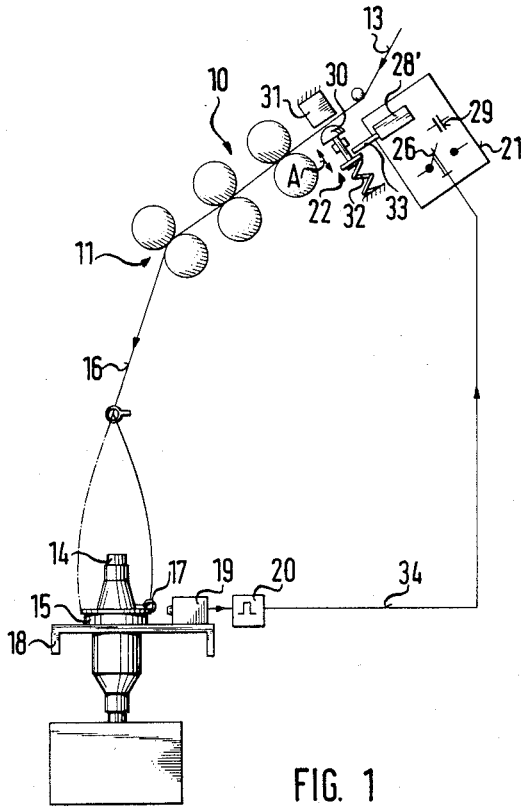

The invention relates to a spinning machine for producing a thread, comprising a multiplicity of spinning stations at which sliver is spun into thread, each of the spinning stations including a thread-break sensor and a slubbing, roving or card sliver-stopping device connected to the sensor and released by an electrical current from the sensor for automatically arresting the sliver or slivers at the spinning station after each thread break sensed by the sensor.

Spinning machines of this type include ring-spinning machines, open-end spinning machines, cap-spinning machines, can, pot or centrifugal-spinning machines and the like.

Slubbing, roving or card sliver stopping devices stop the feed of sliver into the respective spinning station in case of a thread break. The waste of sliver can be avoided in this manner. In many cases, sliver which is not processed into thread causes malfunctions at the respective spinning station. For example, if the spinning station includes a roller carding device for stretching the sliver, the sliver can wrap around the upper or lower delivery roller in a fiber lap and can lead to damage to the stretching mechanism, if the feed to the respective spinning station is not stopped. In open-end spinning machines, continued feeding of the sliver after a thread break can jam the spinning unit of the affected spinning station.

Various constructions of slubbing-stopping devices are known. They are activated to stop the sliver in case of a thread break, by means of a current surge. The current surge excites the coil of an electromagnet of the stopping device, which causes or triggers a suitable mechanical activity that stops the sliver or slivers at the respective spinning station. For example, the current surge can initiate the opening of the carding device at the respective spinning station, so that no sliver is pulled in. A normally open clamping device may be provided before the rollers or before the open-end spinning unit of the respective spinning station, which can stop the sliver which moves toward the carding device, or can stop all of the slivers by clamping in case there are several slivers. This clamping device is closed by an electromagnet, which moves the clamping device from its open position into a position in which it clamps either one or more slivers and thereby stops the feeding of the sliver, after it is activated by a current surge.

If the respective thread break has been repaired, either by an automatic thread splicing device or by the operator of the machine, either the carding device is closed again or the clamping device is opened again, so that the sliver or slivers are transported at this spinning station again. In some cases, clamping devices can be used which only clamp the sliver or slivers for the duration of the current surge, while the current flow is maintained long enough to cause the tearing of the sliver or slivers. Other electrically activated stopping devices for the slubbing are also possible.

Each electrically activated slubbing, roving or card sliver stopping device requires electrical energy over a short time span for activation. Normally this energy is supplied in the form of a current surge. For example, a few milliseconds are sufficient if it is only necessary to move the stopping device from its normal position to the position in which it stops the sliver or slivers. If the slubbing, roving or card sliver stopping device is only moved to the position where the sliver or slivers are stopped, the stopping device is supplied with electric current until the sliver or slivers are torn off, and for this purpose time periods of less than one minute are sufficient as a rule.

Thread breaks occur relatively rarely and are distributed statistically over time. Therefore, during the normal operation of a spinning machine, it does not create a problem to provide the electrical energy for operating the stopping devices from a comparatively small energy source. Under special operating conditions, such as when restarting a partially utilized spinning machine, wherein only a part of the spinning stations produce threads and the other spinning stations run empty, or if a great number of thread breaks simultaneously occur due to an operating error or a machine malfunction, the affected thread-break sensors trigger the simultaneous activation of a great number of slubbing, roving or card sliver stopping devices, possibly several hundreds of such devices. If the electrical energy supply of the stopping devices is constructed for these rare cases, i.e. in such a way that it can deliver the total required energy which is sufficient to simultaneously activate all of the stopping devices, problems and difficulties are encountered at the spinning machine. The reason for this is that it is desirable, even for safety reasons alone, to operate such slubbing, roving or card sliver stopping devices with relatively low voltages. Providing such a high amount of energy at low voltage for the simultaneous operation of all stopping devices is undesirable for construction as well as for safety reasons, and can also cause other problems.

It is accordingly an object of the invention to provide a spinning machine which overcomes the hereinaforementioned disadvantages of the heretofore-known devices of this general type and to provide an energy supply for the slubbing, roving or card sliver stopping devices which assures a reliable operation of a great number of simultaneously operated stopping devices for the slubbing, roving or card sliver, with a relatively low current strength.

With the foregoing and other objects in view there is provided, in accordance with the invention, a spinning machine for producing a thread, comprising a multiplicity of spinning stations at which sliver is spun into thread, each of the spinning stations including a thread-break sensor and a slubbing-stopping device connected to the sensor and released by an electrical current from the sensor for arresting the sliver after each thread break sensed by the sensor, each slubbing-stopping device including an electrical energy storage device, a charging circuit for the storage device, and means for discharging the storage device for operating the slubbing-stopping device.

By providing separate electrical energy storage assigned to each slubbing, roving or card sliver stopping device, the stopping device can be connected to one or more electrical energy sources without difficulty, which deliver 5 to 30 V operating voltage, for example, and whose nominal electrical power is or are much smaller than the total power consumption of the slubbing, roving or card sliver stopping devices connected thereto. The nominal power of the electrical energy source can be so small that it is just sufficient to charge the energy storage devices of the spinning machine over a rather long time period.

In accordance with another feature of the invention, the storage device is a capacitor.

In accordance with a further feature of the invention, the storage device is a rechargeable battery.

It is advantageous if the value of each capacitor or each battery cell is chosen in such a way that the electrical energy stored therein is just sufficient to operate the associated slubbing, roving or card sliver stopping device once.

In accordance with an added feature of the invention, the slubbing-stopping device consumes a given total quantity of instantaneous power during operation thereof, and including a current source connected to the slubbing-stopping device for directly feeding at least the given total quantity of instantaneous power directly to the slubbing-stopping device.

In this way, the nominal power of the energy source or energy sources for this machine can be especially small. This achieves the following advantages: If the rare case occurs in which a great number of threads break simultaneously and consequently the energy storage devices of the respective slubbing, roving or card sliver stopping devices discharge simultaneously and the electrical current supply is required to recharge these energy storages for an extended time span, a thread break may occur during this re-charging period, at a spinning station whose energy storage device is not yet sufficiently recharged to operate its stopping device. In such cases, it is advantageous to directly supply the individual slubbing, roving or card sliver stopping device from the energy source with sufficient current to operate the stopping device. In some cases, even the respective partially recharged energy storage also can discharge and supply additional current. Since there is only a single thread break in this case and not the simultaneous breaking of many threads, in these cases the energy source can be used for directly supplying a sufficiently large current surge for operating the respective slubbing, roving or card sliver stopping devices. This makes it possible to use an energy source with an especially low nominal power rating, even if very long charging times for the energy storage devices thereby become necessary.

If the charging times are not very long, or if it is possible to tolerate a situation in which after the simultaneous occurrence of a great number of thread breaks, rarely occurring additional thread breaks during the recharging time are not immediately taken care off by operating the slubbing stopping device, it is possible to prevent the operation of such slubbing stopping devices with only the energy from the associated energy storage device, and with only the current delivered to it directly from the energy source.

In accordance with a further feature of the invention, the charging circuit of each slubbing-stopping device includes a rectifier and an ohmic resistor connected in series with the capacitor, and each slubbing-stopping device includes a current branch connected in parallel with the capacitor, the current branch including a switch for turning the slubbing-stopping device on and off and an electrical load of the slubbing-stopping device.

In accordance with a concomitant feature of the invention, in each slubbing-stopping device: the ohmic resistor is connected between the rectifier and the capacitor and is connected to the rectifier by a first line and to the capacitor by a second line; the electrical load is a coil; the current branch includes another rectifier feeding a discharge current from the capacitor to the coil, a third line between the second line and the other rectifier and a fourth line between the other rectifier and the coil; and a fifth line connected from the fourth line to the first line.

Other features which are considered as characteristic for the invention are set forth in the appended claims. Although the invention is illustrated and described herein as embodied in a spinning machine, it is nevertheless not intended to be limited to the details shown, since various modifications and structural changes may be made therein without departing from the spirit of the invention and within the scope and range of equivalents of the claims.

Figure 2:
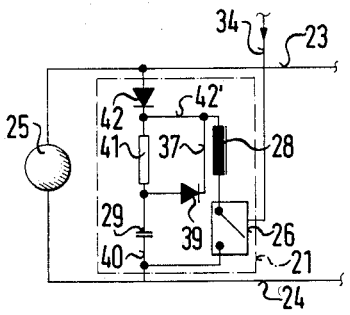
Figure 3:
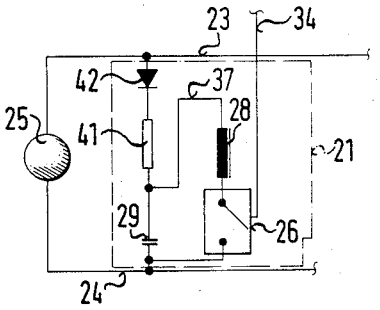

The construction and method of operation of the invention, however, together with additional objects and advantages thereof will be best understood from the following description of specific embodiments when read in connection with the accompanying drawings, in which:

FIG. 1.is a diagrammatic, side-elevational view of a spinning station of a ring spinning machine including a large number of such spinning stations distributed along one or both longitudinal sides of the machine; and FIGS. 2 and 3 are schematic circuit diagrams of embodiments of electric circuits for a device for stopping the slubbing, roving or card sliver of the spinning station according to FIG. 1.

Referring now to the figures of the drawings in detail and first, particularly, to FIG. 1 thereof, there is seen a spinning station 10 including a roller drafting device 11 which stretches sliver 13 supplied in a slightly twisted condition. The stretched sliver coming from the drafting device 11 is twisted to form a thread by means of a spindle 14, a spinning ring 15 and a traveller 17 which moves on the spinning ring 15 and is pulled by the thread. A thread 16 is wound onto a tube sleeve which is mounted on the spindle 14.

A thread-break sensor 19 is disposed at a ring rail 18 which carries the spinning rings 15 at the illustrated side of the machine, laterally adjacent each spinning ring, such as the ring 15. The thread-break sensor 19 senses each passage of the traveller 17 by induction. As long as the traveller 17 regularly passes the thread-break sensor 19 due to its rotation, this indicates that a thread break has not occurred and a signal generator 20, which is connected downstream of the thread-break sensor 19, does not issue a signal. However, if the thread 16 breaks, the traveller 17 stops on the ring 15 and the thread-break sensor responds to the failure of the traveller 17 to appear, which causes the signal generator 20 to issue a short pulse with a preset length a very short time after the last passage of the runner 17. The pulse which indicates a thread break is supplied to a circuit 21, which is part of a slubbing, roving or card sliver stopping device 22, which is assigned to the spinning station.

Each spinning station 10 of the spinning machine has a respective thread-break sensor 19, signal generator 20 and a slubbing, roving or card sliver stopping device 22 with the associated circuitry. For example, if the machine has one thousand spinning stations 10, one thousand units are also provided with the components 19, 20 and 22.

In FIGS. 2 and 3, two typical embodiments of the circuit 21 are shown, which contain capacitors as energy storage devices. All of the circuits 21 of the spinning machine are connected through two common main lines 23, 24 to a common current source 25, which can be a direct current or alternating current source and can be disposed at the spinning machine or at another location at a distance from the machine. The circuits 21 of all of the slubbing, roving or card sliver stopping devices 22 of the machine can be connected to the two main lines 23, 24.

As shown in FIG. 1, each circuit 21 has an electronic switch 26, a coil of an electromagnet 28' of the associated slubbing, roving or card sliver stopping device 22 and a capacitor 29. All of the circuits 21 of the spinning machine are identically constructed. The circuits 21 will be further explained below. The device 22 for stopping the slubbing, roving or card sliver of this spinning machine can also be identically constructed.

Each slubbing stopping device 22 has a clamping element 30 which can move up and down in the direction of a double-sided arrow A. The clamping element is positioned opposite a fixed, immovable anvil 31, over which a roving passes from a non-illustrated spool and runs to the drafting device 11, so that the roving becomes a slightly twisted sliver 13. A compression spring 32 is held in the tensioned position by a latch 33, which can be unlatched by the electromagnet 28', in order to free the spring 32.

The output of the signal generator 20 is connected by the line 34 to the electronic switch 26 of the circuit 21 for opening and closing the switch. The switch 26 is opened for a short time after a thread break occurs and thereafter is immediately closed again and remains in the closed position until the next thread-break signal occurs.

The signal generator 20 thus only supplies one very short thread-break signal to the switch 26 for each thread break. In the circuit according to FIG. 2, a coil 28 of the electromagnet 28' is connected in a current branch 37 in series with the electronic switch 26 and a rectifier 39. A current branch 40 with the capacitor 29 is connected parallel to the current branch 37. These two parallel current branches 37, 40 are connected in series with a resistor 41 and a second rectifier 42. Furthermore, the line between the rectifier 39 and the coil 28 is galvanically or d-c connected with the line between the second rectifier 42 and the resistor 41 by a line 42'.

The charging and discharging of the circuit 21 according to FIG. 2 operates as follows: As long as the switch 26 is open, the capacitor 29 can be charged slowly by a small charging current supplied by the current source 25 through the rectifier 42 and the resistor 41.

If there is a thread break at the spinning station, the switch 26 is closed for the short duration of the pulse which is generated by the signal generator 20, so that the capacitor 29 discharges through the rectifier 39 and the coil 28, which represents the electrical load of the slubbing, roving or card sliver stopping device 22, and through the switch 26. The current surge flowing through the coil 28 during the discharge of the charged capacitor 29, is sufficient to excite the electromagnet 28' enough so it retracts the latch 33 and frees the spring 32 which moves the clamping element 30 toward the anvil 31. The sliver 13 which runs through the drafting device 11, is therefore clamped onto the anvil 31 and stopped. The drafting device 11 continues to run and the sliver 13 is broken between the slubbing, roving or card sliver stopping device 22 and the carding device. This occurs if the capacitor 29 is fully loaded when the thread break occurs, independently of whether this is the only thread break at the spinning machine, or a great number of thread breaks simultaneously occur at any number of other spinning stations at the machine.

As mentioned above, the closing of the switch 26 always occurs for only a short time after a thread break occurs and the switch is then opened again until the next break occurs. After the switch has opened again, the capacitor 29 is again slowly charged with a small charging current from the current source 25. The charging time depends on the magnitude of the resistor 41 and can take between one minute and one hour, for example. If another thread break occurs at the same spinning station while the capacitor 29 is still charging, the switch 26 is closed again. However, this is a rare occurrence statistically and as a rule no other thread breaks occur at the spinning machine. In such a case, there is still a sufficiently strong current surge through the coil 28 for activating the stopping device 22, because the current source 25 will supply sufficient current to the coil 28 through the rectifier 42 and the line 42', because under this condition it does not have to simultaneously supply current for many other coils, which would be beyond its capability. Under normal circumstances, the current source 25 can additionally supply a current surge for the coil 28 of the slubbing, roving card sliver stopping device, or if necessary for the coils of a limited number of other stopping devices, besides the small charging currents for all of the capacitors 29. Statistically, only a few thread breaks occur during normal operation, so that as a rule all of the capacitors are fully charged and only the capacitor at an individual spinning station is discharged due to thread breakage. However, if a great number of thread breaks occur or are announced simultaneously due to a particular event, such as when starting up with only partly activated spinning stations or during a malfunction or faulty operation of the spinning machine, all of the stopping devices 22 at the spinning stations where thread breaks are sensed can be simultaneously electrically activated to clamp the roving due to the charged capacitors 29, and even one or more additional coils 28 can also be electrically excited directly by the current source 25, if the respective capacitors 29 are not yet sufficiently recharged due to preceding thread breaks.

Immediately after the electromagnets 28' of the respective roving, card sliver or slubbing stopping devices 22 have been activated, the electronic switches 26 are opened again and the current source 25 starts to reload the affected capacitors 29. In such a case the required charging current is small, because the charging resistances are relatively high. During this charging period, a great number of new thread breaks cannot occur, if the repairing of a great number of thread breaks requires more time than is required by the charging of the capacitors 29. Furthermore, the occurrence of simultaneous thread breaks in greater numbers is a rare occurrence and it can be assumed that it will not occur twice during the short time required to charge the capacitors.

Upon the occurrence of individual thread breaks while the capacitors 29 are fully charged, which is usually the case, after each closing of the switch 26, not only is the respective capacitor 29 discharged through the coil 28, but current flowing through the coil can also flow through the rectifier 42 and the line 42'. However, this does not do any harm, because the coil 28 can handle this current. Furthermore, if a great number of thread breaks occurs simultaneously, the respective coils 28 are only supplied with current by the capacitors, so that the maximum current which the current source 25 can deliver is distributed over a great number of coils and only very little current is supplied by the current source to each coil 28, so that these currents flowing directly from the energy source 25 to the coils 28 would not suffice to activate a greater number of slubbing, roving or card sliver stopping devices 22.

In many cases during the statistically rarely occurring thread breaks, it is not necessary for the current source 25 to directly supply the coils 28 with current for operating the respective stopping devices 22 if the capacitors 29 are not yet sufficiently charged. In this case the circuit 21 for charging and discharging can be simplified. For example, the circuit shown in FIG. 3 is provided, which only requires a single rectifier 42 in series with the resistor 41 and the capacitor 29 and a current branch 37 with the coil 28 and the switch 26 which is connected in parallel with the capacitor 29.

A rechargeable battery could also be used instead of the capacitor 29.

In both embodiments which are used as examples, the rectifier 42 and the resistor 41 form the charging circuit for the capacitor 29.

The foregoing is a description corresponding in substance to German application P 35 26 309.1, dated July 23, 1985, the International priority of which is being claimed for the instant application, and which is hereby made part of this application.

I claim:

1. Spinning machine for producing a thread, comprising a multiplicity of spinning stations at which sliver is spun into thread, each of said spinning stations including a thread-break sensor and a slubbing-stopping device connected to said sensor and released by an electrical current from said sensor for arresting the sliver after each thread break sensed by the sensor, each slubbing-stopping device including an electrical capacitor; a charging circuit for said capacitor including a first rectifier, an ohmic resistor connected between said first rectifier and said capacitor, said ohmic resistor being connected to said first rectifier by a first line and to said capacitor by a second line, a coil, another rectifier connected to said second line by a third line and to said coil by a fourth line for permitting discharge current to flow from said capacitor to said coil, and a fifth line connected from said fourth line to said first line; and means for discharging said capacitor for operating said slubbing-stopping device.

2. Spinning machine according to claim 1, wherein said slubbing-stopping device consumes a given total quantity of instantaneous power during operation thereof, and including a current source connected to said slubbing-stopping device for directly feeding required electric current directly to said slubbing-stopping device if said given total quantity of instantaneous power consumption permits.

* * * * *